US007467488B2

(12) United States Patent
Lee

(10) Patent No.: US 7,467,488 B2
(45) Date of Patent: Dec. 23, 2008

(54) PICTURE STAND

(76) Inventor: Tony Lee, 12743 Cameron Ave., Sylmar, CA (US) 91342

( * ) Notice: Subject to any disclaimer, the term of this patent is extended or adjusted under 35 U.S.C. 154(b) by 427 days.

(21) Appl. No.: 11/400,937

(22) Filed: Apr. 8, 2006

(65) Prior Publication Data

US 2007/0235619 A1 Oct. 11, 2007

(51) Int. Cl.
*A47G 1/06* (2006.01)

(52) U.S. Cl. ..... 40/746; 248/459; 248/472; 40/745; 40/124.16; 40/773; 40/768

(58) Field of Classification Search ..... 40/745, 40/746, 748, 754, 755, 757, 761, 763, 773, 40/768, 759, 124.16–124.18; 248/467, 472, 248/459, 475.1, 476, 489, 497, 493, 498
See application file for complete search history.

(56) References Cited

U.S. PATENT DOCUMENTS 3,273,272 A * 9/1966 Paige ..... 40/124.16
5,056,250 A * 10/1991 Weissleder et al. ..... 40/539
5,075,991 A * 12/1991 Wenkman et al. ..... 40/781
5,240,287 A * 8/1993 Nirmel ..... 283/101
5,857,278 A * 1/1999 Perkins, Jr. ..... 40/790
5,868,373 A * 2/1999 Duff ..... 248/459
6,427,371 B2 * 8/2002 Olson et al. ..... 40/789
6,634,127 B2 * 10/2003 Bauer ..... 40/792
6,715,226 B1 4/2004 Sikanovski
6,779,286 B2 * 8/2004 Shaffer et al. ..... 40/606.16
7,000,882 B2 * 2/2006 Snuffer et al. ..... 248/459
7,316,085 B1 * 1/2008 Freeman ..... 40/124.14

* cited by examiner

*Primary Examiner*—Joanne Silbermann
*Assistant Examiner*—Shin Kim
(74) *Attorney, Agent, or Firm*—Edwin Tarver; Patel & Alumit, PC

(57) ABSTRACT

A device for displaying photographs or other similar flat items comprising a first panel, a second panel connected to the first panel, first and second flap segments connected to bottom edges of the first and second panels, respectively, and a third and fourth panel connected to left and right side edges of the first and second panels, wherein all panel connections are along fold lines. A sloping cut disposed on each of the first and second panels is designed to create a "V" shaped slit in the middle of the device. A hole disposed at the midpoint of the slit accommodates a single point hanging means. Two holes disposed at the extreme ends of the slit accommodate a line hanging means. A folded state is achieved by folding the device along the fold lines and by maintaining suitable angles for the panels and flap segments. In both the folded and unfolded condition, adhesive on the third and fourth panels is used to secure the device on to the back of a photograph or other similar flat item.

7 Claims, 6 Drawing Sheets

PICTURE STAND

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to display devices such as free standing picture frames, and more particularly to a device for displaying photographs or other similar flat items. The device is an inexpensive unitary piece of simple construction.

Freestanding pictures frames are used to display photographs. A variety of designs and constructions of picture frames are known in the art. Typically, such frames have a means of grasping a photo and maintaining it in position.

Several devices for displaying photographs have been developed in art. For example, U.S. Pat. No. 6,779,286 to Shaffer discloses a panel display system, which includes three separate flat display panels for temporary attachment and removal of photographs, documents, visual aids or the like. The three panels are rotatably connected to one another by hinges. By rotating the panels about their hinges, the display system can be readily converted to a single panel display or a dual panel display. Support members are provided for use when the system is configured as a single panel display.

U.S. Pat. No. 5,857,278 to Perkins discloses an image or object support apparatus that holds and displays an image or object, such as a photograph, drawing or other graphic work in a spaced position relative to a backing plate. The image or object is supported by struts having grippers enabling easy changing of the image or object.

U.S. Pat. No. 5,075,991 to Wenkman discloses a frame for display of items such as picture, photograph, certificate, document or the like. The display item is held against the back plate. The frame has a bracket such that the frame may be mounted upon surfaces such as table, desk, counter or the like. The bracket may be inserted into different sockets to change the orientation of the display item. The frame may also be mounted upon a vertical surface by use of holes depending upon the desired orientation of the display item.

U.S. Pat. No. 6,427,371 to Olsen discloses picture frames constructed from a single flat die-cut foldable paperboard blank convertible into a three-dimensional picture frame without requiring the use of adhesive, adhesive tape, staples, clips or other fastening materials. The picture frame is created by using a paperboard blank, which includes a plurality of rectangular panels separated by fold lines. The rectangular panels are approximately the size of the photograph to be displayed with an opening in the panel through which the photo may be viewed. The rectangular panels include infolding flaps to entrap the photo and hold it in place. Although this picture frame is a unitary piece, the shape and design achieved by folding a paperboard is different from the present invention. Moreover, the means to hold the photograph using the infolding flaps is different from the present invention, which uses slit or cuts for holding the photographs.

Although several picture holding devices are known in the art, the object of the present invention is to provide a unitary piece display device for photographs or other similar flat items that is inexpensive and simple in construction.

A further object is to provide a display device that has a three-dimensional appearance when folded.

A further object is to provide a display device that can also be used in its unfolded condition.

Finally, it is an object of the present invention to provide a display device that uses cuts, folds, holes, and slits to hold and display photographs or other similar flat items. These and other objects of the present invention will become better understood with reference to the appended Summary, Description, and Claims.

SUMMARY

The present invention relates in general to display devices, and more particularly to a device for displaying photographs or other similar flat items. The device is a unitary piece and comprises four panels and two flap segments. A first panel is connected to a second panel along a fold line. The first and second panels are of the same size. The third and fourth panels are connected to the side edges of the first and second panels, respectively, along fold lines. Two flap segments, first and second, are connected to bottom edges of the first and second panels, respectively, along fold lines.

The device also includes a slit on each of the first and second panels. The two slits meet at the fold line on the intersection of the first and second panels, thereby resulting in V-shaped cut on the device. The slit incorporates three holes, one at the point of intersection of the two slits, and the others at the two points of termination of the slit. In its unfolded condition, the device can be hung on a wall using the hole at the intersection of the two slits in conjunction with a nail or screw, or by passing a string under the V-shaped cut, through the holes at the points of termination of the slit. Adhesive on the third and fourth panels is used to secure the device on the back side of a picture. When the device is folded and adhered to a photo, the device will hold the photo upright on a surface.

FIGURES—REFERENCE NUMERALS

Figure 1:
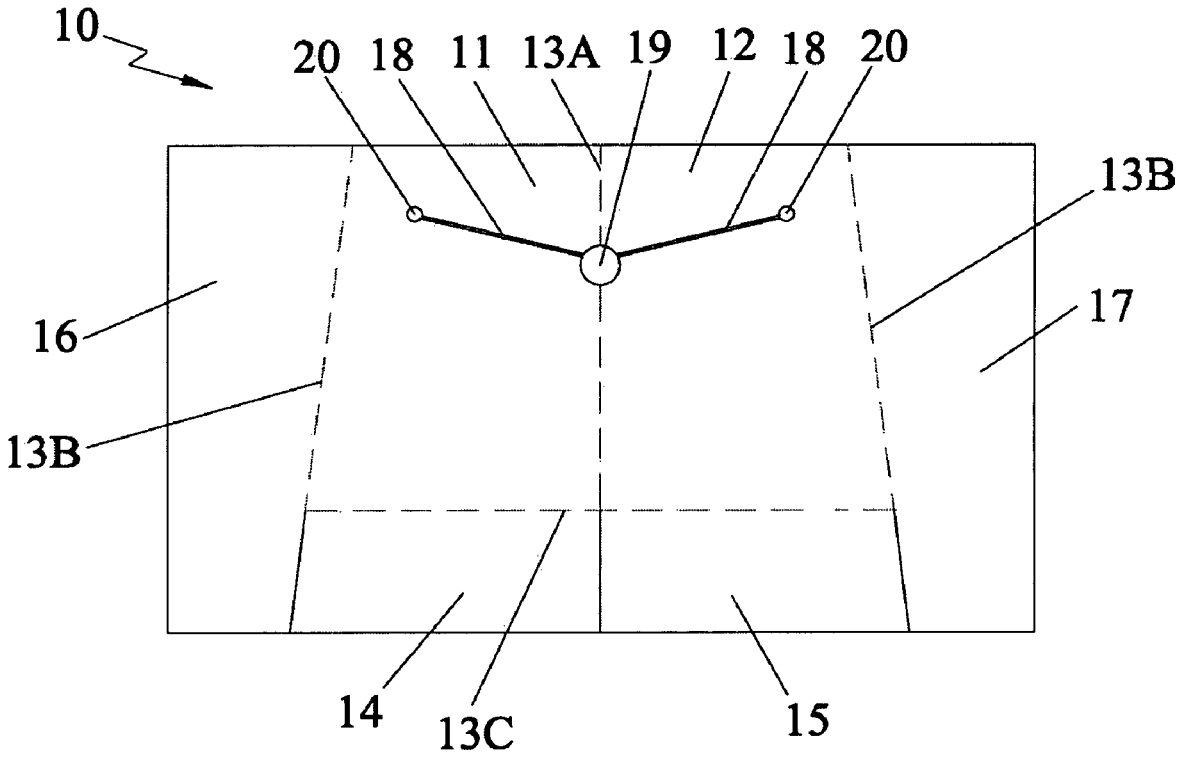
FIG. 1 is a plan view of the device for holding photographs or other similar flat items in accordance with the present invention.

10 . . . Device of the Present Invention
11 . . . First Panel
12 . . . Second Panel
13 . . . Fold Line
14 . . . First Flap Segment
15 . . . Second Flap Segment
16 . . . Third Panel
17 . . . Fourth Panel
18 . . . Slit
19 . . . Hole on the Fold Line
20 . . . Hole at Point of Termination of the Slit
21 . . . String
22 . . . Screw
23 . . . Back of Photograph or Other Similar Flat Item
24 . . . Adhesive
25 . . . Wall
26 . . . Photograph or Other Similar Flat Item

DETAILED DESCRIPTION

Referring to the drawings, a preferred embodiment of a device for displaying photographs or other similar flat items is illustrated and generally indicated as 10 in FIGS. 1 through 6. The device 10 is a unitary piece and has a three-dimensional appearance in its folded state.

Referring to FIG. 1, the device 10 in its unfolded state is illustrated. The device 10 comprises a plurality of panels and flap segments connected by fold lines. The device 10 includes a first panel 11 that is proportionately sized to correlate to the size of the photograph to be displayed. A second panel 12 which is of the same size of the first panel 11 is connected thereto along fold line 1 3A. The right side edge of the first panel 11 is connected to a left side edge of the second panel 12 along the fold line 13A. A first flap segment 14 and second flap segment 15 is connected to the bottom edges of the first and second panels, respectively, along fold lines 13B. The device further includes third and fourth panels 16 and 17 connected to left side and right side edges of the first panel and second panels, respectively, along fold lines 13C.

The device includes two slits 18, one on the first panel 11 and the other on the second panel 12. The two slits 18 slope downwards and meet on the fold line 1 3A connecting the first and second panels. This intersection of the two slits 18 results in V-shaped cut on the device. A hole 19 is included at the intersection of the two slits for receiving a hanging means, such as a hook or nail. The device also includes two holes 20 at the point of terminations of the two slits. These two holes 20 are suitably dimensioned to accommodate a string 21.

Figure 2:
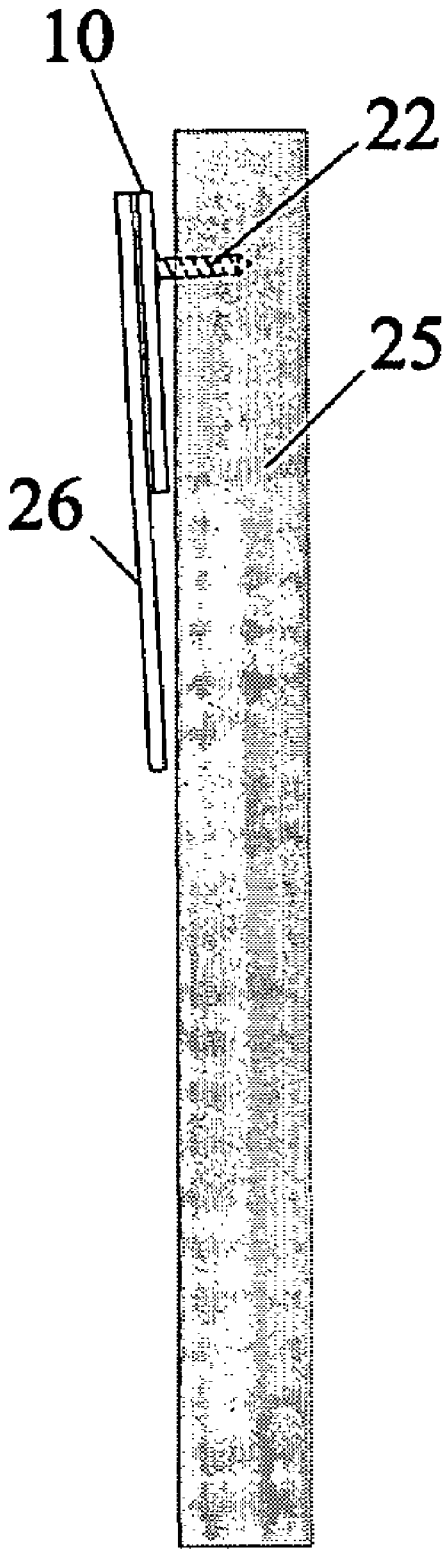
FIG. 2 is a side view of the device being hanged by a screw.
Figure 3:
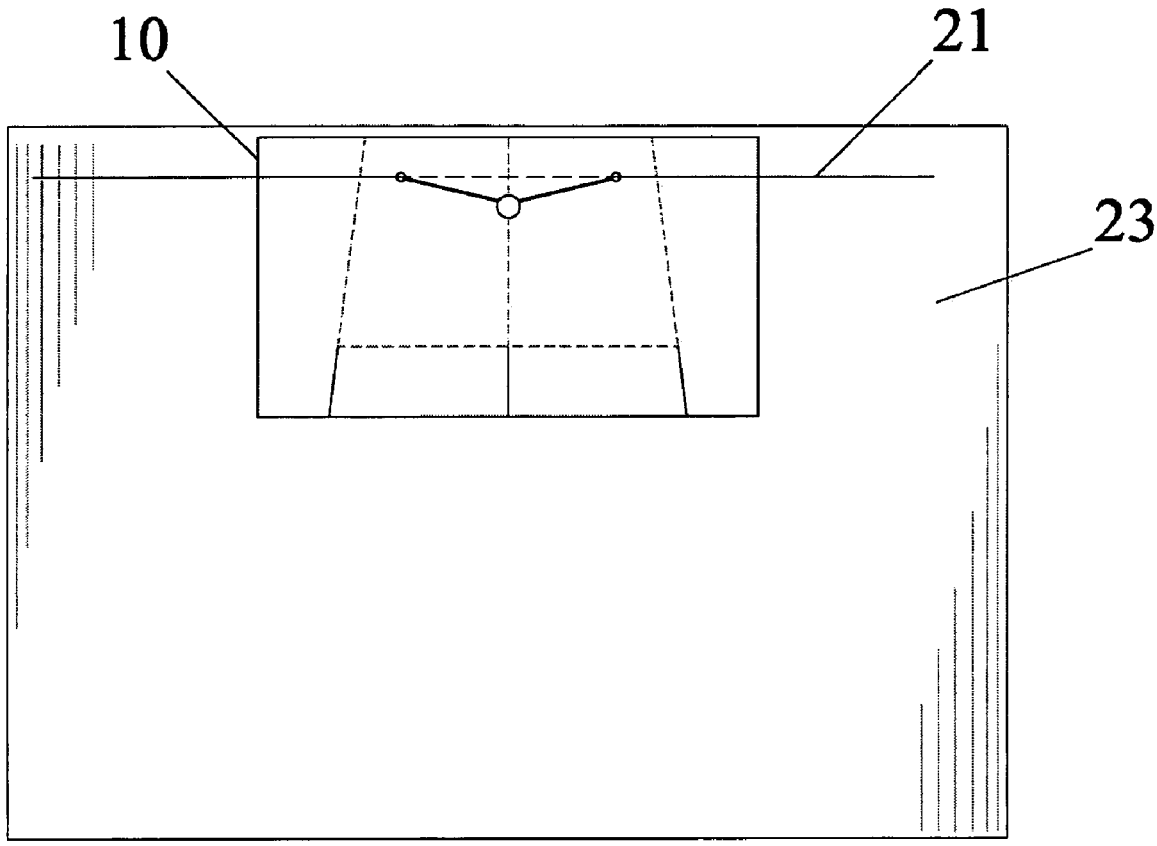
FIG. 3 is a plan view of the device that is suspended over a string.
Figure 4:
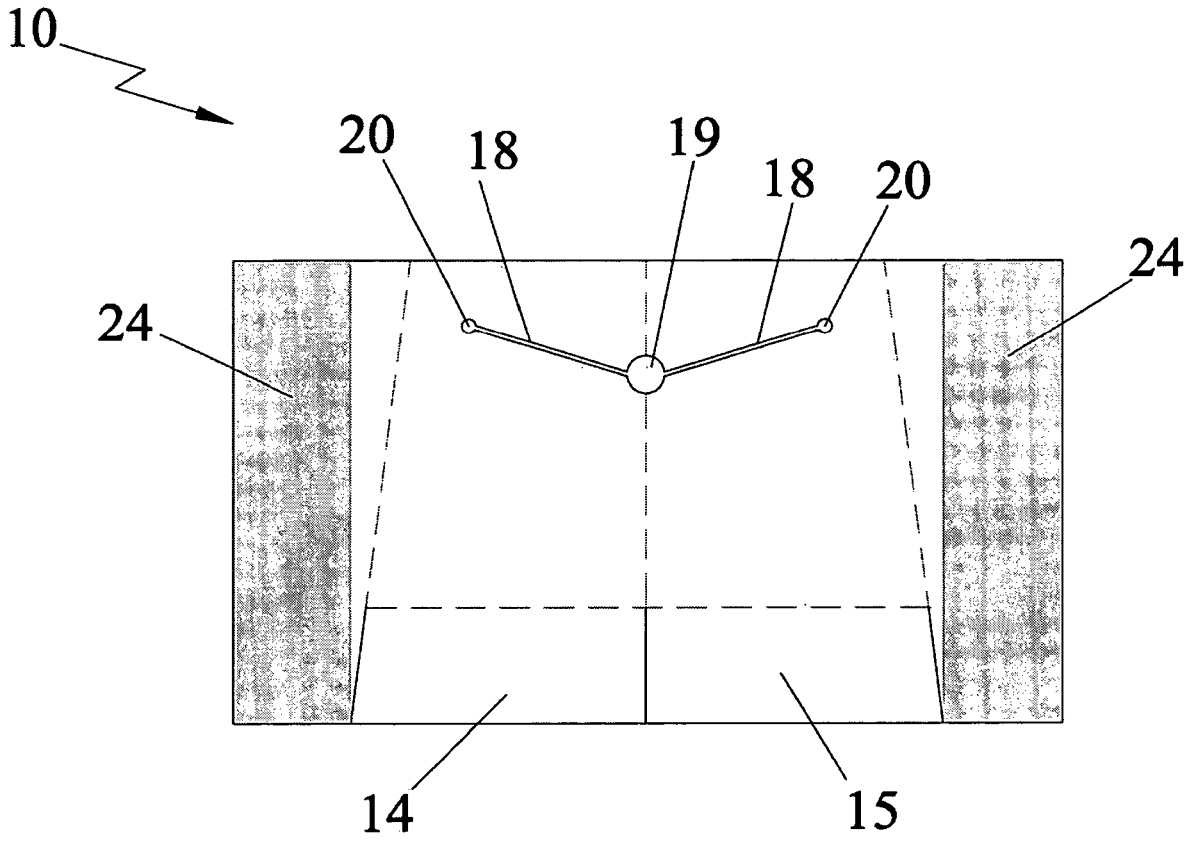
FIG. 4 is a plan view of the device with adhesive.

The device 10 can be mounted in many ways to display photographs. In its unfolded state, the device 10 is flat and can be mounted to a hanging means, such as a nail 22, on a wall 23 through the hole 19 at the intersection of the two slits 18, as seen in FIG. 2. Alternatively, the device can be suspended over a string 21 as seen in FIG. 3. The V-shaped cut allows the string 21 to pass through and be received in the holes 20 at the point of termination of the slits 18.

The folded state of the device 10 is achieved by folding it along the fold lines 13 such that the third and fourth panels are in same plane as the photograph, and the first and second panels maintain an angular relationship to each other, and to the third and fourth panels, respectively. Several folding conditions can be achieved by using different suitable angles for the fold lines 13.

Figure 5:
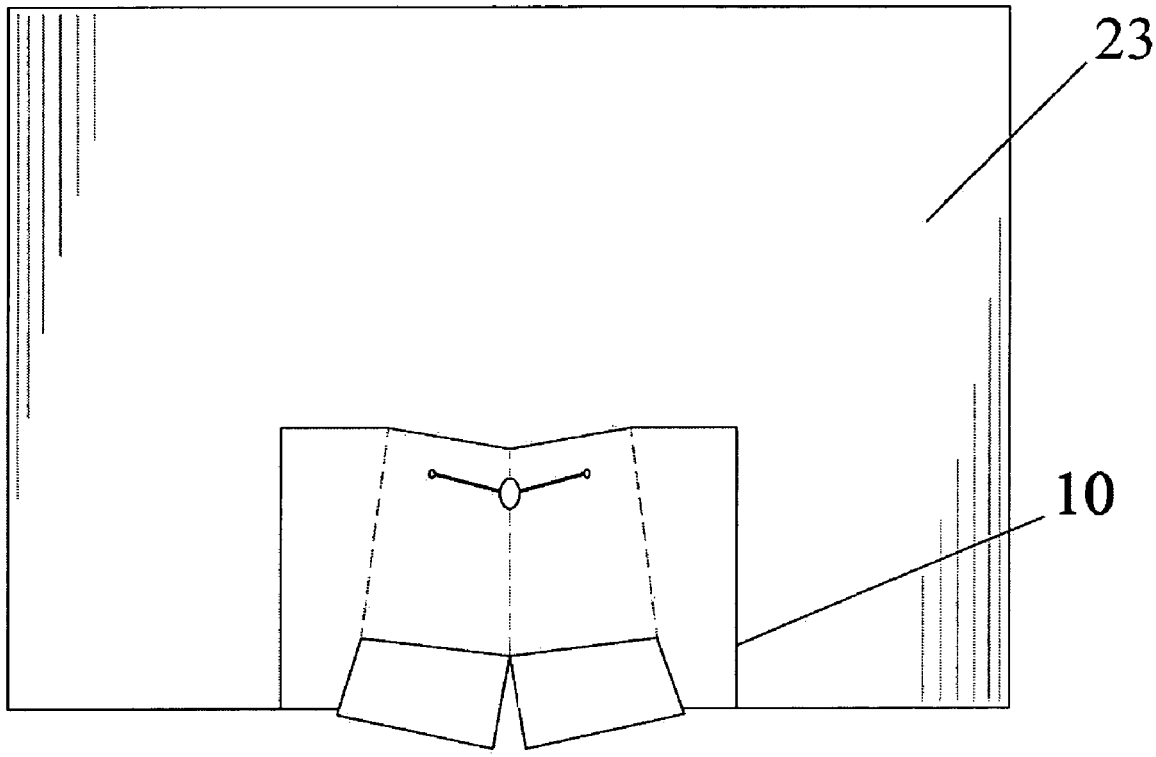
FIGS. 5 and 6 are different views of the device that is secured to the back of a photograph or other similar flat item using the adhesive.
Figure 6:
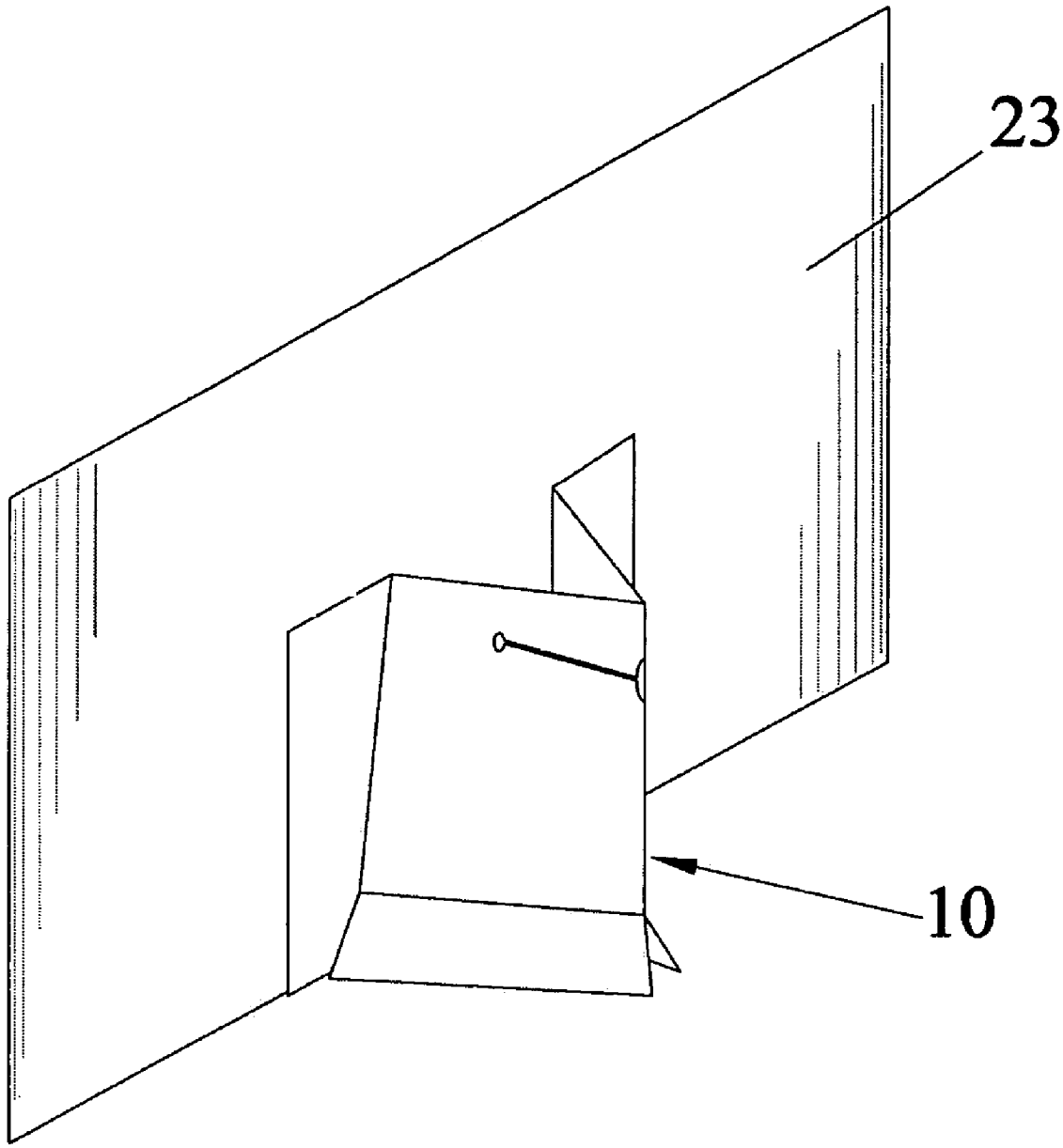

Referring to FIGS. 5 and 6, in its folded condition, the device 10 can be supported on a horizontal planar surface. Adhesive 24 is further used to secure the device 10 to the back of a photograph or other similar flat item. The adhesive 24 is adhered on surfaces of the third and fourth panels 16 and 17. The third and fourth panels 16 and 17 are then adhered to the back of a photograph or other similar flat item by the adhesive 24. The first flap segment 14 and second flap segment 15 are designed to provide additional support and the desired display angle and enable the bottom edge of the device 10 to uniformly abut the surface on which it rests.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A device for displaying photographs or other similar flat items comprising;

a first panel and a second panel of the same size as the first panel, each of the said first and second panel having at least four edges wherein the right side edge of the first panel is connected to the left side edge of the second panel along a fold line;

a first flap segment connected to a bottom edge of the first panel along a fold line;

a second flap segment connected to a bottom edge of the second panel along a fold line;

a third panel connected to the left side edge of the first panel along a fold line;

a fourth panel connected to a right side edge of the first panel along a fold line;

a sloping slit on each of the first and second panels resulting in a "V" shape, with a hole disposed at the intersection of the first and second panel, and a hole disposed at the opposite end of each slit;

wherein the device is maintained in a flat condition or in a folded condition against the back of a photograph or flat panel, the folded condition being achieved by folding the device along the fold lines such that the third and fourth panels are in same plane, the first panel and second panels maintain an angular relationship, and the first panel and second panels maintain an angular relationship with the third and fourth panels.

2. The device of claim 1, wherein a hole is disposed on the fold line connecting the first and second panels, the hole being adapted to receive a hanging means on a vertical surface for hanging the device.

3. The device of claim 2, wherein the sloping slits on the first and second panels slope downward and meet at the hole on the fold line connecting the first and second panels.

4. The device of claim 3, wherein, in the flat condition, a string is passed through the sloping slits in order to hang the device.

5. The device of claim 4, wherein the device includes two holes accommodate the string, each of the two holes being disposed at the point of termination of the two sloping slits opposite the center of the device.

6. The device of claim 1, wherein the two holes disposed at the point of termination of the sloping slits accommodate a string to pass through them.

7. The device of claim 1, wherein adhesive is used as a means to adhere the device on to the back of a photograph or other similar flat item, the adhesive is adhered on the third and fourth vertical panels.

* * * * *